US006319033B1

(12) United States Patent
Ma

(10) Patent No.: US 6,319,033 B1
(45) Date of Patent: Nov. 20, 2001

(54) ELECTRICAL CONNECTOR WITH IMPROVED ACTUATOR

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/814,006

(22) Filed: Mar. 20, 2001

(30) Foreign Application Priority Data

Dec. 28, 2000 (TW) ..... 89222646 U

(51) Int. Cl.[7] ..... H01R 13/15; H01R 13/62
(52) U.S. Cl. ..... 439/260; 439/495
(58) Field of Search ..... 439/260, 261, 439/495

(56) References Cited

U.S. PATENT DOCUMENTS 5,695,359 * 12/1997 Fujikura et al. ..... 439/495
5,842,883 * 12/1998 Igarashi et al. ..... 439/495
6,089,905 * 7/2000 Shimmyo et al. ..... 439/495
6,203,345 * 3/2001 Roque et al. ..... 439/260

* cited by examiner

*Primary Examiner*—Tulsidas Patel
*Assistant Examiner*—Hae Moon Hyeon
(74) *Attorney, Agent, or Firm*—Wei Te Chung

(57) ABSTRACT

An electrical connector (100) includes an insulative housing (102), a number of contacts (104) received in the housing and an actuator (106) pivotably engaging with the housing for driving a flexible printed circuit (FPC) received in a mating port (116) of the connector to electrically contact the contacts. The housing has a top wall (108), a bottom wall (110) and two opposite side walls (112) and defines a chamber (114) between the top, the bottom and the side walls. The side walls each define a guiding slot(120) near the mating port for slidably receiving pivots (130) of the actuator therein. The guiding slot has an upper segment (123) and a lower segment (125) separated by a rib (117) therebetween. When the pivots of the actuator slide along the guiding slot from the upper segment to the lower segment, the actuator downwardly moves to securely press conductive trails of the FPC to contact the electrical contacts of the housing, thereby establishing electrical connection therebetween.

8 Claims, 7 Drawing Sheets

ELECTRICAL CONNECTOR WITH IMPROVED ACTUATOR

BACKGROUND OF THE INVENTION

1. Field of the Invention

The present invention relates to a flexible printed circuit (FPC) connector, and particularly to an FPC connector having an improved actuator permitting insertion of an FPC to the FPC connector by Zero Insertion Force and firm securement of the FPC to the FPC connector.

2. Description of the Related Art

U.S. Pat. Nos. 5,401,186, 5,474,468 and 5,695,359 each disclose a flexible printed circuit (FPC) connector for electrically connecting an FPC to a printed circuit board (PCB). The FPC connector includes an insulative housing mounted on the PCB and a plurality of contacts received in cavities of the housing. The housing defines a mating port communicating the cavities for receiving an end of the FPC so that conductive trails of the FPC may electrically connect the contacts. Furthermore, the connector includes an actuator near the mating port. The actuator has two engaging arms near two opposite ends thereof which pivotably engage with the housing such that the actuator is upwardly and downwardly movable to lock the FPC to the connector.

Usually, to facilitate assembling the actuator to the housing, the engaging arms of the actuator are elastic. The elasticity of the engaging arms, however, weakens the securement of the engagement of the engaging arms with the housing. In other words, the engaging arms of the actuator of the conventional connector are likely to disengage from the housing, which may result in disengagement of the FPC from the conventional connector.Hence, an improved electrical connector is required to overcome the disadvantages of the prior art.

SUMMARY OF THE INVENTION

An object of the present invention is to provide an electrical connector having an improved actuator permitting insertion of an FPC to the FPC connector by Zero Insertion Force and firm securement of the FPC to the FPC connector.

To realize the above object, a flexible printed circuit connector includes an insulative housing defining a chamber, a number of contacts received in the housing and partially extending into the chamber and an actuator pivotably assembled to the housing for accommodating a flexible printed circuit (FPC) by Zero Insertion Force and retaining the FPC in the chamber.

The housing has a top wall, a bottom wall, two opposite side walls and the chamber is defined between the top wall, the bottom wall and the side walls. The chamber includes a mating port at a front section thereof which is defined between the bottom wall, the actuator and the two side walls for insertion of the FPC into the chamber. The side walls each define a guiding slot near the mating port for slidably engaging with a corresponding engaging arm of the actuator. The guiding slot has an upper segment and a lower segment separated by a rib. Each engaging arm has a pivot slidably received in the guiding slot of the housing to be located either in the upper segment of the guiding slot in which the FPC is insertable into the chamber by Zero Insertion Force or in the lower segment of the guiding slot in which the FPC is firmly secured in the chamber by the actuator.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
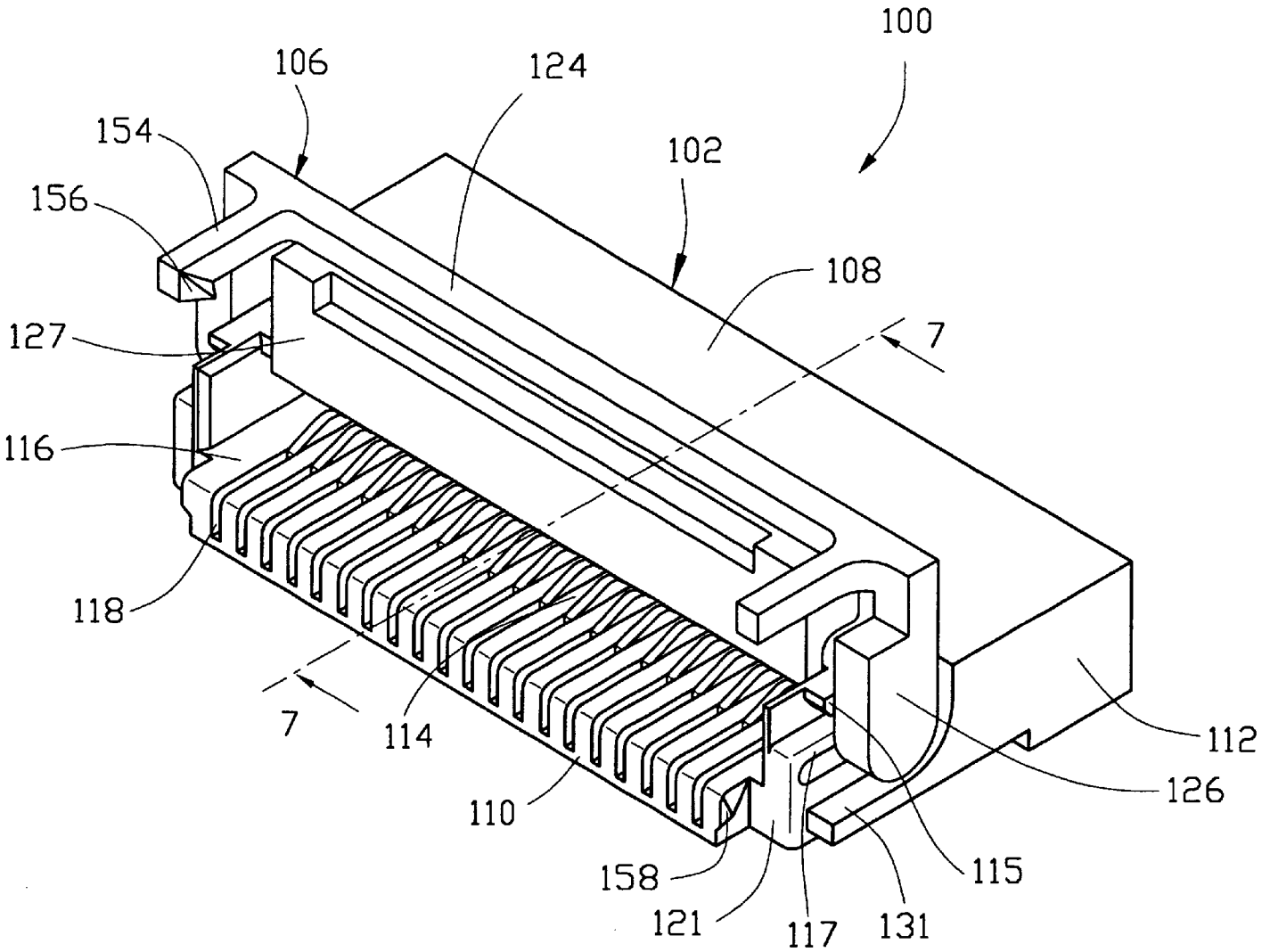
FIG. 1 is a perspective view of a flexible printed circuit connector of the present invention wherein an actuator of the connector is open and ready for accommodating a flexible printed circuit.
Figure 2:
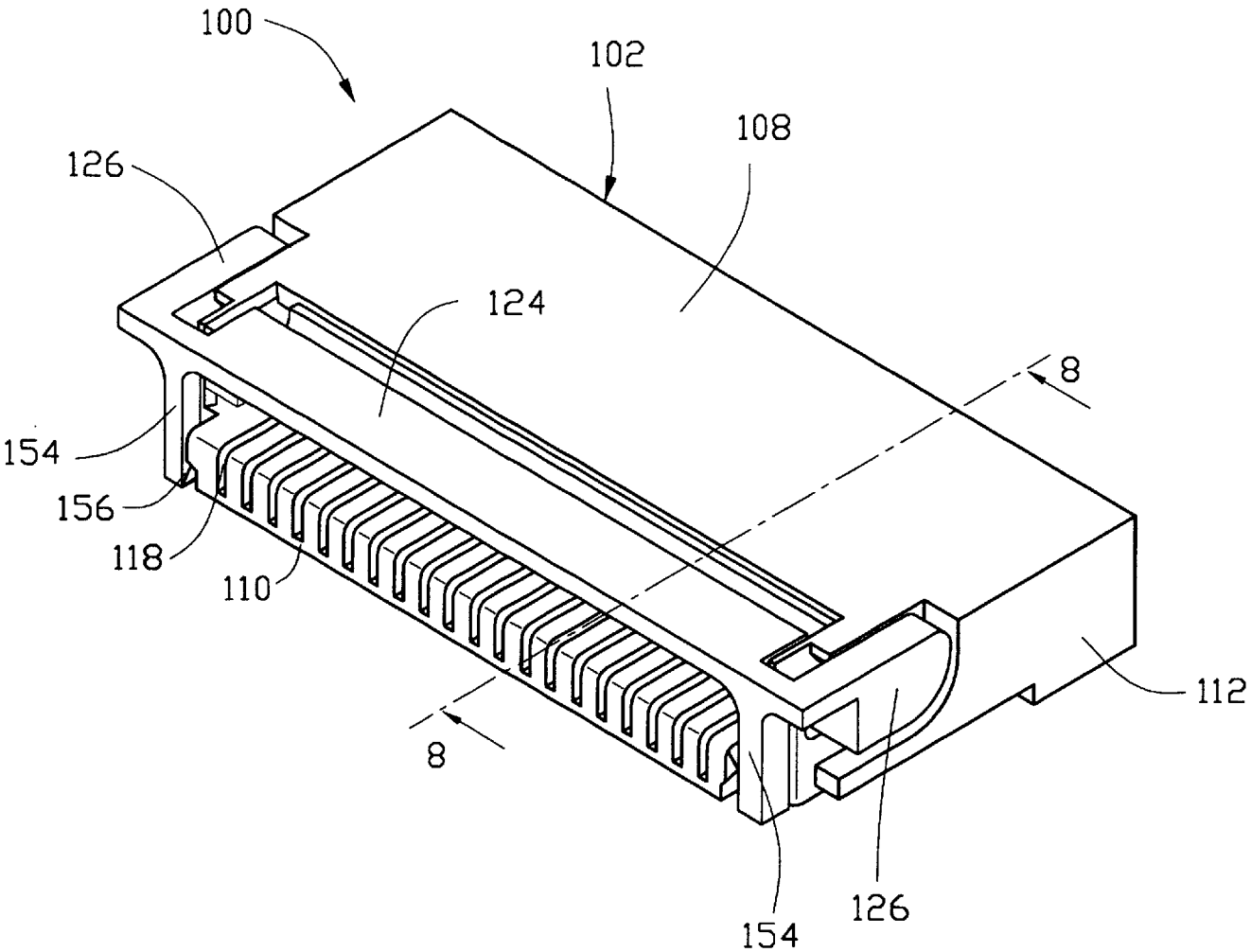
FIG. 2 is similar to FIG. 1 but the actuator is closed.
Figure 3:
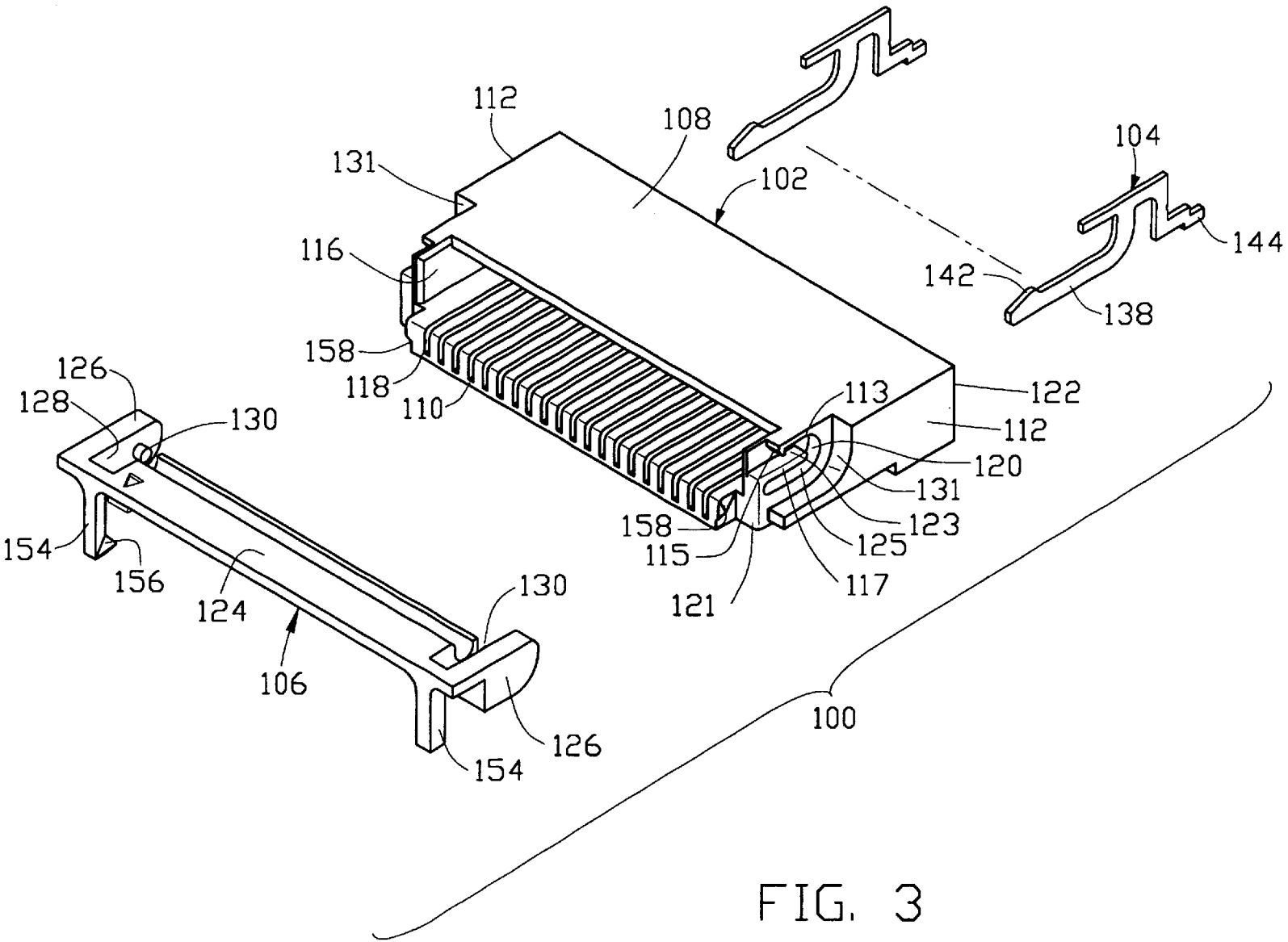
FIG. 3 is an exploded perspective view of FIG. 1.

Referring to FIGS. 1–3, a flexible printed circuit (FPC) connector 100 of the present invention comprises an insulative housing 102, a plurality of conductive contacts 104 received in the housing 102 and an actuator 106 pivotably assembled to the housing 102. The housing 102 includes a top wall 108, a bottom wall 110 and two side walls 112 at opposite ends of the top wall 108 and the bottom wall 110. The housing 102 defines a chamber 114 between the top wall 108, the bottom wall 110 and the two side walls 112 for accommodating a flexible printed circuit (FPC, not shown). The chamber 114 includes a mating port 116 at a front section thereof which is defined between the bottom wall 110, and the actuator 106 for insertion of the FPC into the chamber 114. The bottom wall 110 defines a plurality of cavities 118 for receiving corresponding contacts 104.

Each side wall 112 of the housing 102 defines a guiding slot 120 at a front end 121 thereof near the mating port 116 for slidably engaging with the actuator 106. The guiding slot 120 has a configuration like a recumbent U alphabet and includes an upper segment 123 and a lower segment 125 separated by a rib 117. The housing 102 forms an elastic arm 113 above each rib 117 and the upper segment 123 of the guiding slot 120 is defined between a corresponding elastic arm 113 and a corresponding rib 117. The elastic arms 113 each form a hook 115 at a free end thereof. The hook 115 downwardly extends from a free end of the elastic arm 113 into the upper segment 123 of guiding slot 120. Each side wall 112 defines a recess 131 at the front end 121 thereof for facilitating engagement of the actuator 106 with the housing 102. The bottom wall 110 of the housing extends beyond the front end 121 and forms two projections 158 on opposite side face thereof.

Each contact 104 includes an engaging portion 138 fixedly received in a corresponding cavity 118 of the bottom wall 110 and a tail portion 144 rearwardly extending beyond a rear face 122 of the housing 102 for mounting to a printed circuit board (PCB, not shown). The engaging portion 138 forms a ridge 142 at an end thereof for electrically contacting conductive trails of the FPC.

The actuator 106 includes an elongate bar 124, two engaging arms 126 rearwardly extending from opposite ends of the elongate bar 124 and a tongue portion 127 rearwardly extending from the elongate bar 124 and between the two engaging arms 126. The engaging arms 126 are rigid such that, when the actuator 106 is assembled to and disassembled from the housing 102, the engaging arms 126 are unmovable relative to the tongue portion 127. There is a slit 128 between each engaging arm 126 and the tongue portion 127. Each engaging arm 126 forms a pivot 130 thereof confronting the tongue portion 127. The actuator 106 includes two latches 154 downwardly extending from the elongate bar 124. Each latch 154 is near and perpendicular to a corresponding engaging arm 126. Each latch 154 forms a protrusion 156 extending from a distal end of the latch toward the other latch.

Figure 4:
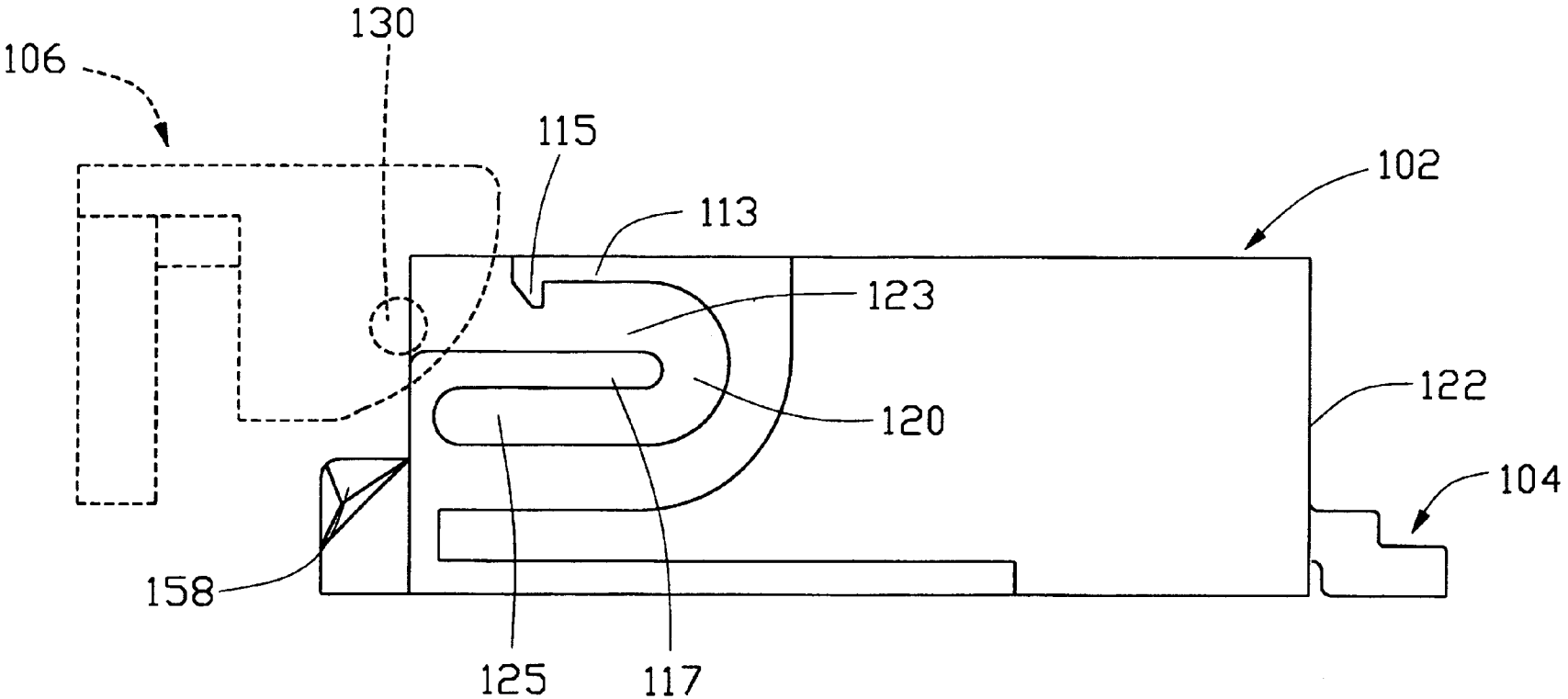
FIG. 4 is a side view of the connector in FIG. 1, wherein the actuator shown in broken lines is beginning to assemble to the housing.

Further referring to FIG. 4, in assembly, the contacts 104 are assembled to the housing from the rear face 122 thereof. The engaging portions 138 are fixedly received in the cavities 118 with the ridges 142 thereof extending into the chamber 114 of the housing 102. The tail portions 144 of the contacts 104 extend beyond the rear face 122 of the housing 102. The actuator 106 is moveably assembled to a front portion of the housing 102. The engaging arms 126 are moveably received in the recesses 131 of the housing 102 and the pivots 130 are slidably located in the upper segment 123 of the guiding slot 120. The elasticity of the elastic arms 113 facilitates the insertion of the pivots 130. The hooks 115 permit the insertion of the pivots 130 into the guiding slot 120 but counteract disengagement of the pivots 130 from the housing 102. The actuator 106 is moveable in accordance with slippage of the pivots 130 along the guiding slot 120.

Figure 5:
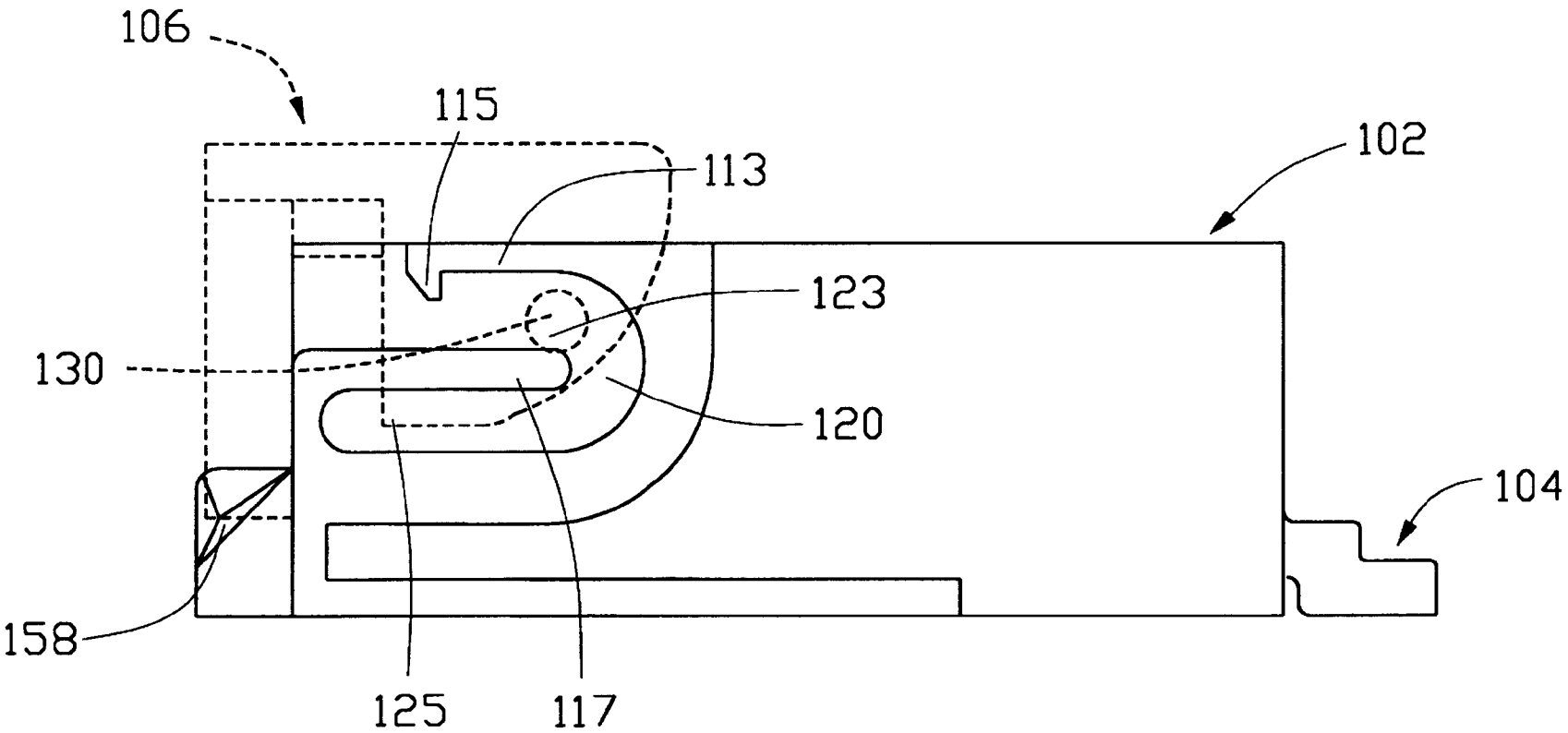
FIG. 5 is similar to FIG. 4 but the actuator is completely assembled to the housing and is located at an unlocking position.
Figure 6:
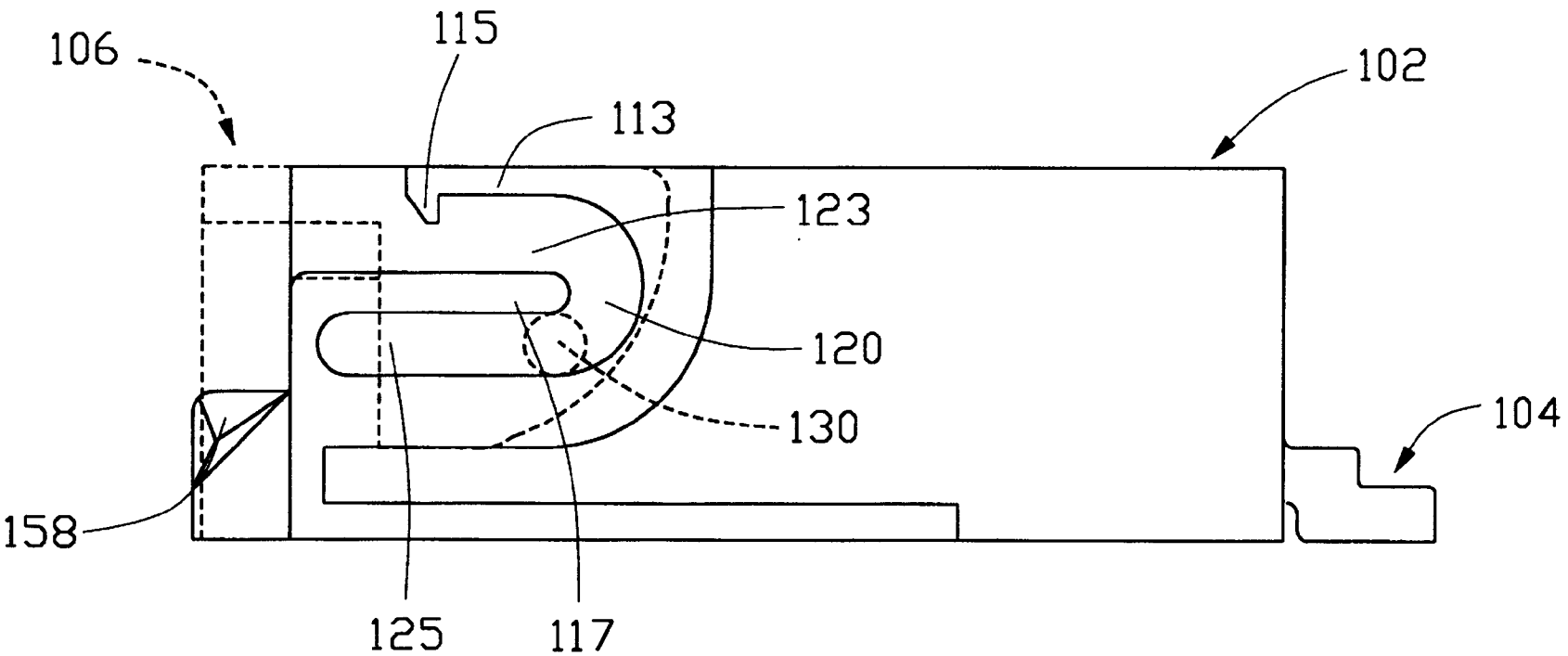
FIG. 6 is similar to FIG. 5 but the actuator is located at a locking position.
Figure 7:
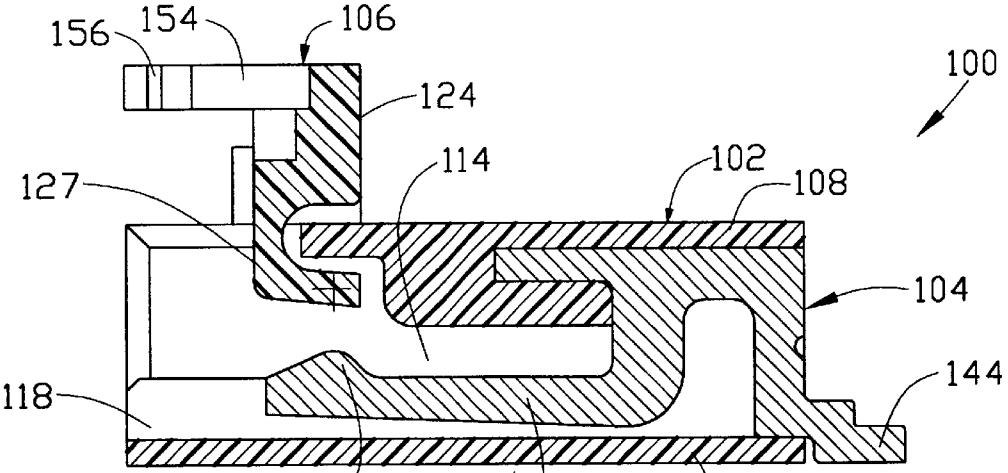
FIG. 7 is a cross-sectional view taking along line 7—7 of FIG. 1.
Figure 8:
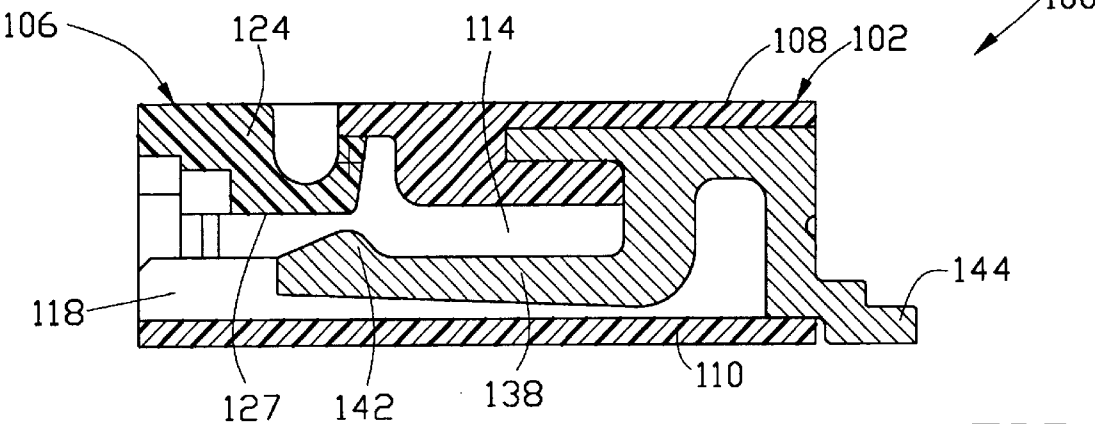
FIG. 8 is a cross-sectional view taking along line 8—8 of FIG. 2.

Referring to FIGS. 1, 5 and 7, when the pivots 130 of the actuator 106 are located in the upper segment 123 of the guiding slot 120, the tongue portion 127 of the actuator 106 spaces in a direction perpendicular to the bottom wall 110 from the ridges 142 of the contacts 104 a distance greater than the thickness of the FPC so that the FPC is insertable into the chamber 114 by Zero Insertion Force. Referring to FIGS. 2, 6 and 8, after the FPC is completely inserted into the chamber 114 via the mating port 116, the actuator 106 is operated so that the pivots 130 slip into the lower segment 125 of the guiding slot 120 and the actuator 106 totally sinks a distance equal to the summation of the diameter of the pivot 130 and the thickness of the rib 117. In this instance, the tongue portion 127 of the actuator 106 spaces in the same direction from the ridges 142 of the contacts 104 a distance smaller than the thickness of the FPC. The pivots 130 bear against the rib 117 and the tongue portion 127 presses circuit trails of the FPC to contact corresponding ridges 142 of the contacts 104. The protrusions 156 of the latches 154 engage with corresponding projections 158 of the bottom wall 110 of the housing 102.

Comparing with conventional FPC connectors, the FPC connector 100 of the present invention has a lot of advantages. First, after securing the FPC in the chamber 114 of the housing, the engaging arms 126 securely engage with the ribs 117 of the housing 102 because of the rigidity of the engaging arms 126. Second, the recumbent U shape of the guiding slot 120 facilitates the movement of the pivots 130 along the guiding slot 120, thereby facilitating the operation of the actuator 106.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the alternative may apply the guiding slot to the actuator while apply the pivot to the housing.

What is claimed is:

1. An electrical connector comprising:

an insulative housing having a top wall, a bottom wall and two side walls and defining a chamber between the top wall, the bottom wall and the side walls, the bottom wall defining a plurality of cavities communicating the chamber, each side wall defining a U-shaped guiding slot at a front end thereof, the guiding slot including an upper segment and a lower segment;

a plurality of contacts each including an engaging portion and a tail portion, each engaging portion being fixedly received in a corresponding cavity and having a ridge extending into the chamber of the housing, each tail portion rearwardly extending beyond a rear face of the housing; and an actuator having an elongated bar, two engaging arms rearwardly extending from opposite ends of the elongated bar and a tongue portion rearwardly extending from the elongated bar and being located between the two engaging arms, each engaging arm having a pivot confronting the tongue portion, the pivot being slidably received in the guiding slot of the housing to be located either in the upper segment of the guiding slot in which the tongue portion is spaced a first distance from the ridges of the contacts as measured along a direction perpendicular to the bottom wall of the housing or in the lower segment of the guiding slot in which the tongue portion is spaced a second distance from the ridges of the contacts in the same direction which is smaller than the first distance.

2. The electrical connector as claimed in claim 1, wherein the housing has a rib between the upper segment and the lower segment of each guiding slot, the rib bearing against a corresponding pivot of the actuator when the pivot is located in the lower segment of the guiding slot.

3. The electrical connector as claimed in claim 2, wherein the housing has an elastic arm above each rib, the elastic arm having a hook permitting insertion of a corresponding pivot into a corresponding guiding slot but preventing disengagement of the corresponding pivot from the corresponding guiding slot.

4. The electrical connector as claimed in claim 3, wherein the engaging arms of the actuator are rigid and are unmovable relative to the tongue portion of the actuator.

5. The electrical connector as claimed in claim 1, wherein a slit is defined between each engaging arm and the tongue portion of the housing.

6. The electrical connector as claimed in claim 1, wherein each side wall defines a recess at the front end thereof and wherein the engaging arms are moveably received in corresponding recesses.

7. An electrical connector comprising:

an insulative housing having a top wall, a bottom wall and two side walls commonly defining a horizontal chamber, each side wall defining a laterally opened guiding slot therein, the guiding slot including an upper segment and a lower segment;

a plurality of contacts disposed in corresponding cavities and communicating with the chamber, an actuator having an elongated bar with two engaging arms extending from opposite ends thereof and a tongue portion between and extending along a same direction of said two engaging arms, each engaging arm having a pivot facing toward the tongue portion, the pivot being slidably received in the guiding slot of the housing to be located either in the upper segment of the guiding slot where the tongue portion is an upper position in the chamber, or in the lower segment of the guiding slot where the tongue portion is in a lower position in the chamber; and means for restricting upward movement of said pivot from the lower segment to the upper segment.

8. The connector as claimed in claim 7, wherein said means includes a rib to define the corresponding guiding slot with a U-shape.

* * * * *